US011365948B2

(12) United States Patent
Loubser

(10) Patent No.: US 11,365,948 B2
(45) Date of Patent: Jun. 21, 2022

(54) BARREL FLEXING MITIGATION ASSEMBLY

(71) Applicant: Johannes Le Roux Loubser, Scottsdale, AZ (US)

(72) Inventor: Johannes Le Roux Loubser, Scottsdale, AZ (US)

( * ) Notice: Subject to any disclaimer, the term of this patent is extended or adjusted under 35 U.S.C. 154(b) by 0 days.

(21) Appl. No.: 17/059,589

(22) PCT Filed: May 24, 2019

(86) PCT No.: PCT/IB2019/054319

§ 371 (c)(1),
(2) Date: Nov. 30, 2020

(87) PCT Pub. No.: WO2019/239239

PCT Pub. Date: Dec. 19, 2019

(65) Prior Publication Data

US 2021/0207919 A1 Jul. 8, 2021

(30) Foreign Application Priority Data

Jun. 13, 2018 (ZA) ..... 2018/03936

(51) Int. Cl.

| | |
|---|---|
| ***F41A 21/44*** | (2006.01) |
| ***F41C 27/22*** | (2006.01) |
| ***F41C 7/00*** | (2006.01) |

(52) U.S. Cl.

CPC ..... *F41A 21/44* (2013.01); *F41C 7/00* (2013.01); *F41C 27/22* (2013.01)

(58) Field of Classification Search

CPC ..... F41A 21/24; F41A 21/36; F41A 21/44; F41A 3/66; F41A 13/12; F41C 7/00; F41C 27/22

See application file for complete search history.

(56) References Cited

U.S. PATENT DOCUMENTS 2,249,899 A * 7/1941 Hogg ..... F41A 21/02 42/76.01
2,795,881 A * 6/1957 Bellows ..... F41A 21/482 42/75.02

(Continued)

FOREIGN PATENT DOCUMENTS

EP 2 053 338 4/2009

OTHER PUBLICATIONS

International Search Report for PCT/IB2019/054319 dated Jul. 16, 2019, 6 pages.

(Continued)

*Primary Examiner* — Gabriel J. Klein
(74) *Attorney, Agent, or Firm* — Nixon & Vanderhye P.C.

(57) ABSTRACT

The invention provides a barrel flexing mitigation assembly (10), which is suitable for reducing barrel deflection, particularly in long range rifle barrels, such as those used in target shooting, hunting or sniper applications. The barrel flexing mitigation assembly (10) comprises a tubular shaft (20) extending coaxially with a rifle barrel (12) for defining an exoskeleton (20) within which at least part of the barrel (12) is encased; and a tubular barrel stabiliser (22) which is snug-fitted over the barrel (12), such that it is radially positioned between the barrel (12) and the tubular exoskeleton (20).

8 Claims, 5 Drawing Sheets

(56) References Cited

U.S. PATENT DOCUMENTS

| | | | | |
|---|---|---|---|---|
| 3,118,243 | A * | 1/1964 | Manshel | F41A 21/02 42/76.02 |
| 4,327,626 | A * | 5/1982 | McQueen | F41A 3/54 42/72 |
| 5,794,374 | A | 8/1998 | Crandall | |
| 7,353,741 | B2 * | 4/2008 | Brixius | F41A 13/06 42/90 |
| 7,646,496 | B2 * | 1/2010 | Kubota | H04N 1/3875 358/1.1 |
| 8,312,663 | B2 * | 11/2012 | Johnson | F41A 23/16 42/97 |
| 9,038,302 | B1 | 5/2015 | Pochapsky et al. | |
| 10,584,933 | B2 * | 3/2020 | Lagenbeck | F41A 21/24 |
| 2009/0223357 | A1 | 9/2009 | Herring | |
| 2013/0247439 | A1 | 9/2013 | Johnson | |
| 2020/0166304 | A1 * | 5/2020 | Martin | F41A 21/30 |

OTHER PUBLICATIONS

Written Opinion of the ISA for PCT/IB2019/054319 dated Jul. 16, 2019, 5 pages.

* cited by examiner

BARREL FLEXING MITIGATION ASSEMBLY

CROSS-REFERENCE TO RELATED APPLICATIONS

This application is the U.S. national phase of International Application No. PCT/IB2019/054319 filed May 24, 2019 which designated the U.S. and claims priority to ZA 2018/03936 filed Jun. 13, 2018, the entire contents of each of which are hereby incorporated by reference.

INTRODUCTION

According to the invention there is provided a barrel flexing mitigation assembly, which is suitable for reducing barrel deflection, particularly, although not exclusively, in long range rifle barrels, such as those used in target shooting, hunting or sniper applications, and which aims to provide repeatable performance accuracy regardless of the type or calibre of cartridge used.

BACKGROUND TO THE INVENTION

The terms barrel "flexing", "deflection" or "resonance" refer to microscopic flexing of a rifle barrel during a firing process. From the moment that a rifle trigger is pressed and a firing pin strikes a primer, until a bullet leaves a muzzle, a powerful shockwave impulse is impeded into the tubular wall structure of a rifle barrel. Although the major force of this shockwave is mainly in a longitudinal axial direction, the tubular wall structure of the barrel compensates to straighten itself, resulting in radial deflection, which causes the barrel to flex in an unpredictable random pattern. This pattern is influenced by each particular barrel design, the manner in which the barrel is mounted, as well as the specific internal ballistic performance of the ammunition being used.

An additional contortion is induced as a result of twist of the rifling. The bullet begins to spin while it is being propelled forward, imparting a torque on the barrel. All of these movements cause the barrel to stress and deflect in a particular fashion which, if not controlled, cause each projectile to leave the muzzle at a slightly different angle. This, combined with an induced radial acceleration force vector, results in a different Point of Impact (POI) on an intended target with each consecutive shot. As a result, flexing of the barrel is the largest contributor to dispersion of projectiles apart from the skill level of a marksman. Additionally, this effect is increased and amplified as the barrel heats up with repeated firing.

While there are a number of factors that determine the accuracy of a rifle barrel, one of the more critical elements is its stiffness or rigidity. The larger in diameter a barrel is, the stiffer and heavier it will be; and as the length of a barrel increases, it becomes more limber and flexible. In many applications, such as hunter class rifles or sniper rifles, rifle weight is an important factor, as users are often required to carry their rifles and other equipment for long distances, making it important to minimize weight.

From an equipment point of view the accuracy of rifles is driven by weapon/platform design, rifling, barrel length, and ammunition design, such as projectile shape and mass. The longer the barrel, the higher the muzzle velocity. This is purely due to the fact that force is applied over a longer time base. For this reason, target and sniper rifles generally have longer barrel lengths on account of their long-distance requirements. However, there is a practical limit on barrel length, which depends on cartridge calibre. Any firearm cartridge has an optimum barrel length needed in order to fully burn the propellant powder packed into its casing. In order to make full use of the higher amount of propellant used in the cartridges of hunting and sniper rifles and to achieve high bullet kinetic performance and resultant sufficient killing power at long ranges, such rifles use higher power, larger rifle cartridges. These cartridges, being as powerful as they are, contain significantly higher amounts of propellant in their casings, and hence hunting and sniper rifles generally have longer barrel lengths to build up maximum speed and contact time (known as "barrel time" or "t3" in internal ballistic terminology) with the rifling of the barrel to ensure accuracy. However, the use of higher power cartridges within longer barrels increases the accuracy problems resulting from barrel deflection.

In highly accurate rifles, barrels are generally "free-floated", which is a method to ensure that the barrel flexes freely without any object touching the outer surface of the barrel, which will upset the specific dynamic behaviour of the particular barrel. A free-floating barrel is one in which the barrel and stock are designed to not touch at any point along the barrel's length. With some conventional rifles, the barrel can be in contact with the fore-end of a stock. However, temperature or humidity changes or operational use may affect the stock, which may cause the barrel to vary its contact "footprint" with the barrel, resulting in a change in the barrel's dynamics during a launching stage, which can adversely affect the dispersion and/or Point of Impact. Therefore, contact between the barrel and the stock determines and interferes with the normal flexing pattern of the barrel. Since the stock usually consists of materials of other densities than that of the barrel, it has a different dynamic stability and thermal characteristics, which can have a detrimental effect on accuracy, especially when the barrel gets hot with repeated firing. The interference of the stock with the barrel's flexing pattern as the bullet passes down the bore can cause the barrel to behave inconsistently from shot to shot, depending on the interface fit between the barrel and stock as a result of external forces acting upon the stock at the time of a shot.

By contrast, free-floating barrels are assembled such that the barrel contacts the rest of the rifle only at a receiver, which is attached to the stock, but the barrel "floats freely" without contacting other gun parts (except the front sight, which is often mounted on the barrel). This minimizes the variance in possible mechanical pressure distortions of the barrel alignment. Stocks which contact the barrel are still popular for many utility weapons, but most precision rifle designs have largely adopted free-floating barrels.

One prior art attempt to overcome barrel deflection in particularly long length barrels is the use and mounting of a barrel "tuner" or "damper" over the barrel, usually close to the muzzle. This adds weight, in some cases constriction, which minimizes the amount of radial acceleration of the muzzle, which is the final point of separation when the projectile leaves the barrel. However, use of such an add-on standalone device is limited in its effectiveness, because the effect that it has on the accuracy of the rifle depends on the exact positioning of the barrel tuner on the barrel, as well as on cartridge calibre and the specific ammunition being used. Axial location of the device is totally dependent on the ammunition being used, requiring re-adjustment for every ammunition type.

SUMMARY OF THE INVENTION

For purposes of this specification, the term "stock", also known as a gunstock, shoulder stock, a buttstock, or butt, will be understood to a part of a long gun, such as rifle, to which an action and firing mechanism are attached and which is held against a user's shoulder when shooting the rifle. The stock provides a means for a shooter to firmly support the rifle, aim with stability, and also transmits recoil into the shooter's body. The term "action" will be understood to mean a mechanism which handles ammunition loads, and which is typically positioned intermediate the stock and the barrel.

According to a first aspect of the invention there is provided a barrel flexing mitigation assembly adapted for mitigating flexing of a rifle barrel during a firing process, wherein the rifle includes a stock, an action and a barrel terminating in a muzzle, the barrel flexing mitigation assembly comprising— an elongate, tubular shaft extending coaxially with the barrel at least partially between the muzzle and the action such that it defines a rigid exoskeleton within which at least part of the barrel is encased; and an elongate, tubular barrel stabiliser which is snug-fitted with high precision over at least a portion of the barrel, such that it is radially positioned between the barrel and the tubular exoskeleton and stabilises the barrel into radial contact with the exoskeleton;

the arrangement being such that the exoskeleton and barrel stabiliser jointly mitigate and absorb radial displacement of the barrel while a projectile is being fired.

The barrel stabiliser may be fitted over at least a portion of the barrel which is closest to the muzzle. In particular, the barrel stabiliser may be configured such that it extends approximately one third the length of the barrel closest to the muzzle. Alternatively, the barrel stabiliser may extend the length of the barrel between the muzzle and the action.

The barrel stabiliser may include a tubular body which is snug-fitted over the barrel such that it engages an exterior wall surface of the barrel, and at least one spacer radially extending from the tubular body and dimensioned for pressing against an interior wall surface of the exoskeleton, the arrangement being such that a radial chamber is defined between the tubular body of the barrel stabiliser and the exoskeleton. Preferably, the barrel stabiliser includes a number of spacers that radially extend between the tubular body and the exoskeleton such that they frictionally engage the tubular body with the exoskeleton, the spacers being positioned at regular intervals along the length of the tubular body such that a radial chamber is formed between each set of neighbouring spacers, the tubular body and the exoskeleton.

The barrel stabiliser may operatively be associated with securing means for securing the barrel stabiliser onto the exterior wall of the barrel so as to prevent axial displacement of the barrel stabiliser in use. The securing means may be located coaxially with and on opposite sides of the barrel stabiliser.

The barrel stabiliser may be heat conductive such that it may serve as a heat sink, adapted to disperse heat away from the barrel during firing.

The tubular exoskeleton may a rigid metal exoskeleton adapted to provide strength and rigidity to a barrel. It may have any cross-sectional profile including circular, rectangular, square, hexagonal, octagonal, triangular or variations thereof.

In an alternative embodiment of the invention, the tubular exoskeleton may extend coaxially with the barrel from the muzzle to the stock, such that it defines a rigid exoskeleton within which the entire rifle is encased and within which all moving parts, such as the breach bolt carrier assembly, slides.

According to a second aspect of the invention there is provided a barrel flexing mitigation assembly adapted for mitigating flexing of a rifle barrel during a firing process, wherein the rifle includes a butt plate, stock, an action and a barrel terminating in a muzzle, the barrel flexing mitigation assembly comprising— an elongate, tubular shaft extending coaxially with the barrel from the muzzle to the stock, such that it defines a rigid exoskeleton within which the entire rifle is encased and within which all moving parts, such as the breach bolt carrier assembly, slides; and an elongate, tubular barrel stabiliser which is snug-fitted with high precision over at least a portion of the barrel, such that it is radially positioned between the barrel and the tubular exoskeleton and stabilises the barrel into radial contact with the exoskeleton;

the arrangement being such that the exoskeleton and barrel stabiliser jointly mitigate and absorb radial displacement of the barrel while a projectile is being fired.

According to a third aspect of the invention there is provided an elongate, tubular shaft extending coaxially with a rifle barrel at least between the muzzle and the action such that it defines a rigid exoskeleton within which at least the barrel is encased, the exoskeleton being releasably connectable to the rifle barrel.

According to a fourth aspect of the invention there is provided an elongate, tubular barrel stabiliser which is snug-fitted with high precision over at least a portion of a rifle barrel, such that it is radially positioned between the barrel and a tubular exoskeleton and stabilises the barrel into radial contact with the exoskeleton.

According to a fifth aspect of the invention there is provided a rifle including a stock, an action and a barrel terminating in a muzzle, wherein the rifle further includes a barrel flexing mitigation assembly comprising— an elongate, tubular shaft extending coaxially with the barrel at least partially between the muzzle and the action such that it defines a rigid exoskeleton within which at least part of the barrel is encased; and an elongate, tubular barrel stabiliser which is snug-fitted with high precision over at least a portion of the barrel, such that it is radially positioned between the barrel and the tubular exoskeleton and stabilises the barrel into radial contact with the exoskeleton;

the arrangement being such that the exoskeleton and barrel stabiliser jointly mitigate and absorb radial displacement of the barrel while a projectile is being fired.

According to a sixth aspect of the invention there is provided a rifle including a stock, an action and a barrel terminating in a muzzle, wherein the rifle further includes a barrel flexing mitigation assembly comprising— an elongate, tubular shaft extending coaxially with the barrel from the muzzle to the stock, such that it defines a rigid exoskeleton within which the entire rifle is encased and within which all moving parts, such as the breach bolt carrier assembly, slides; and an elongate, tubular barrel stabiliser which is snug-fitted with high precision over at least a portion of the barrel, such that it is radially positioned between the barrel and the tubular exoskeleton and stabilises the barrel into radial contact with the exoskeleton;

the arrangement being such that the exoskeleton and barrel stabiliser jointly mitigate and absorb radial displacement of the barrel while a projectile is being fired.

SPECIFIC EMBODIMENT OF THE INVENTION

Without wishing to be bound thereto, the invention will now further be described and exemplified with reference to the accompanying drawings in which—

A barrel flexing mitigation assembly according to the invention is generally designated by referenced numeral [10]. The barrel flexing mitigation assembly [10] is used on a rifle [8] and is adapted for mitigating flexing of a rifle barrel [12] during a firing process, wherein the rifle [8] includes a stock [14], an action [16] and a barrel [12] terminating in a muzzle [18]. The barrel flexing mitigation assembly [10] comprises an elongate, tubular shaft [20] extending coaxially with the barrel [12] at least between the muzzle [18] and the action [16] such that it defines a rigid exoskeleton within which at least part of the barrel [12] is encased; and an elongate, tubular barrel stabiliser [22] which is snug-fitted with high precision over at least a portion of the barrel [12], such that it is radially positioned between the barrel [12] and the tubular exoskeleton [20] and stabilises the barrel [12] into radial contact with the exoskeleton [20]. The arrangement is such that the exoskeleton [20] and barrel stabiliser [22] jointly mitigate and absorb radial displacement of the barrel [12] while a projectile is being fired.

The barrel stabiliser [22] is fitted over at least a portion of the barrel [12] which is closest to the muzzle [18]. In particular, and as illustrated in the accompanying examples, the barrel stabiliser [22] is configured such that it extends approximately one third the length of the barrel [12] closets to the muzzle [18]. It will, however, be appreciated that the barrel stabiliser [22] can extend the length of the barrel [12] between the muzzle [18] and the action [16].

The barrel stabiliser [22] includes a tubular body [24] which is snug-fitted over the barrel [12] such that it engages an exterior wall surface [26] of the barrel [12]; and at least one spacer [28] radially extending from the tubular body [24] and dimensioned for pressing against an interior wall surface [30] of the exoskeleton [20], the arrangement being such that a radial chamber [32] is defined between the tubular body [24] of the barrel stabiliser [22] and the exoskeleton [20]. Preferably, the barrel stabiliser [22] includes a number of spacers [28] that radially extend between the tubular body [24] and the exoskeleton [20], the spacers [28] being positioned at regular intervals along the length of the tubular body [24], such that a radial chamber [32] is formed between each set of two neighbouring spacers [28], the tubular body [24] and the exoskeleton [20].

Figure 6:
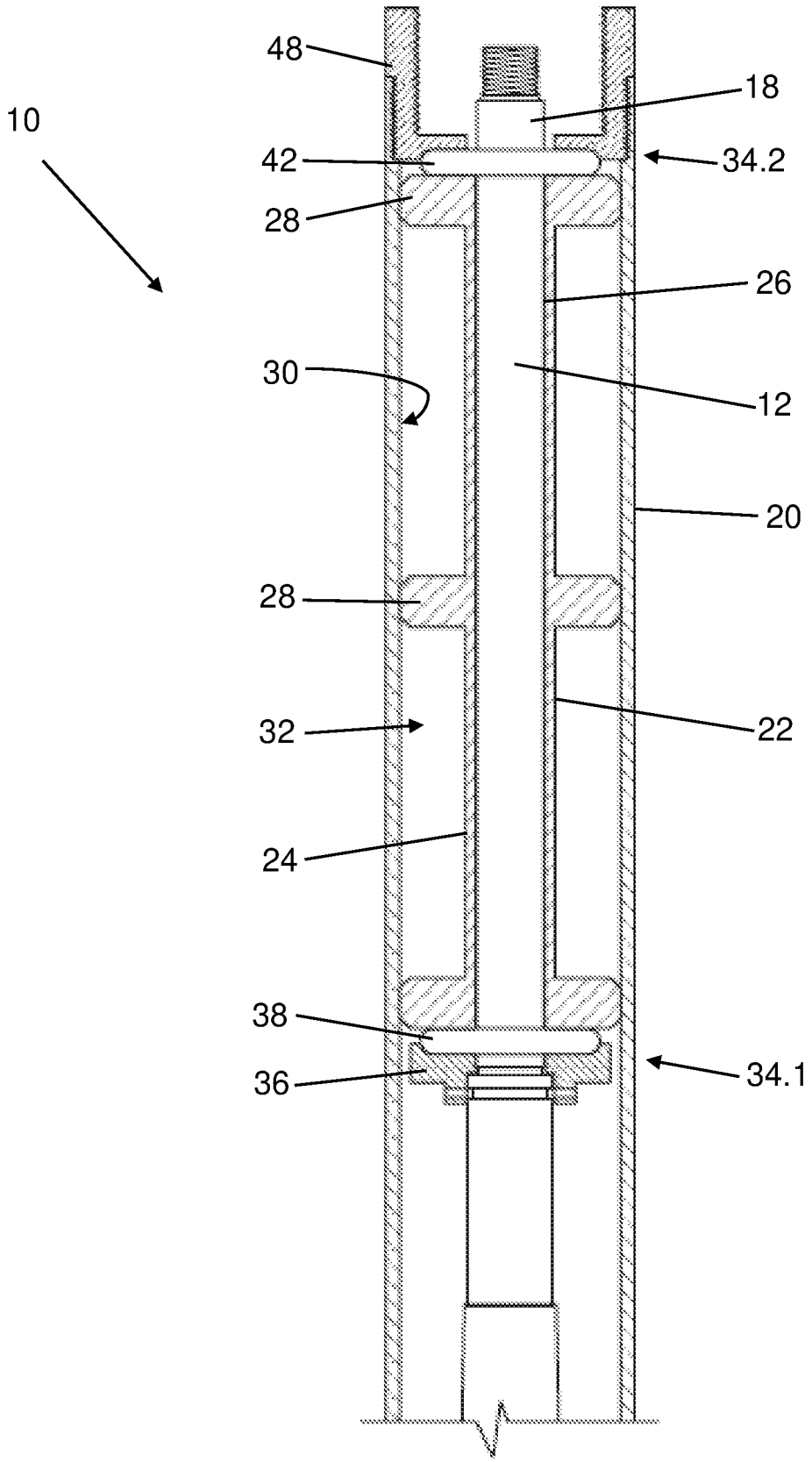
FIG. 6 is an enlarged view of the rifle of FIG. 4, illustrating the exoskeleton and barrel stabiliser approximate the muzzle.
Figure 7:
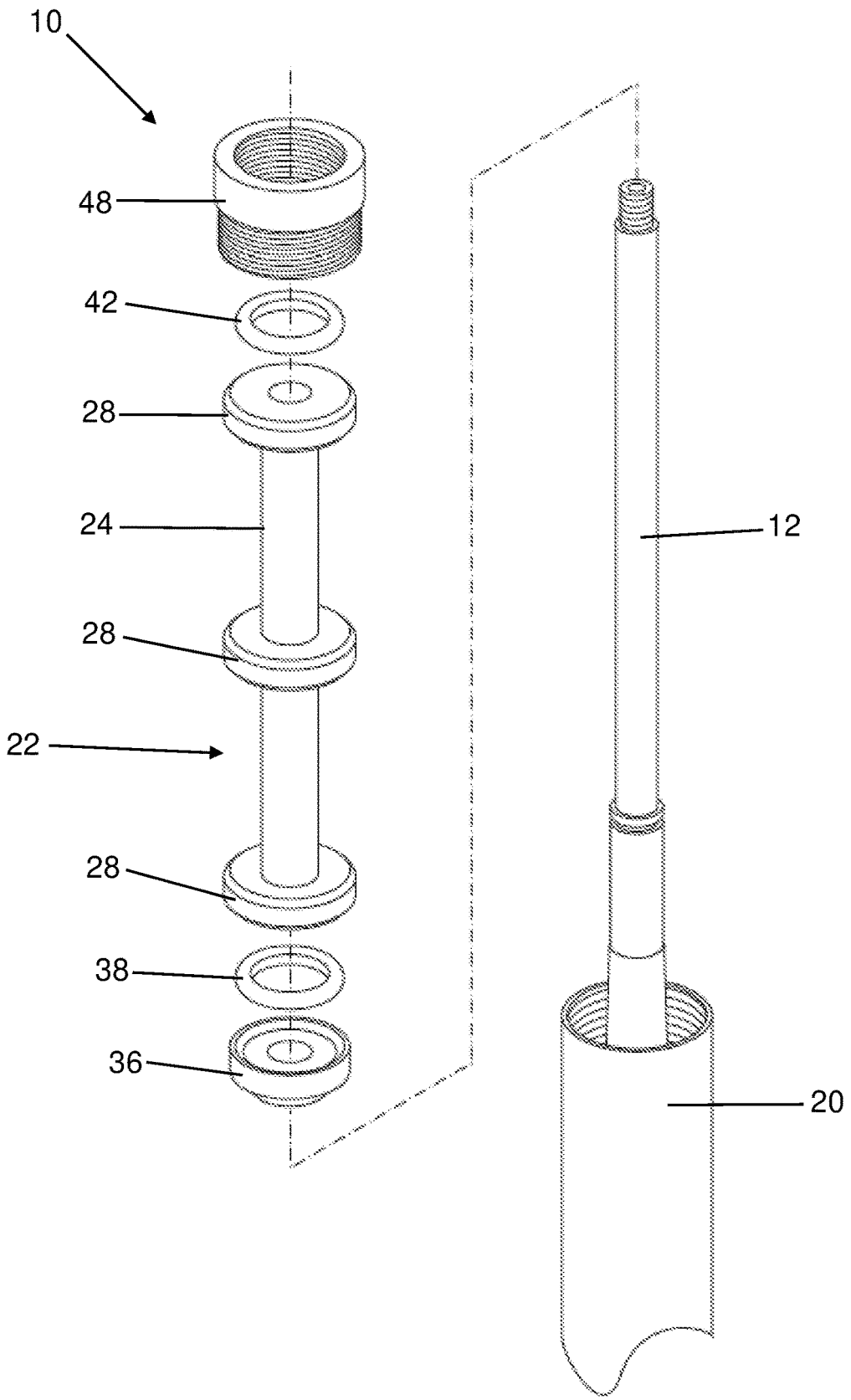
FIG. 7 is an exploded perspective view of the exoskeleton and support of the barrel flexing mitigation assembly of FIG. 4.

The barrel stabiliser [22] is operatively associated with securing means [34.1; 34.2] for securing the barrel stabiliser [22] onto the exterior wall surface [26] of the barrel [12] so as to prevent axial displacement of the barrel stabiliser [22] in use. The securing means [34.1; 34.2] is located coaxially with and on opposite ends of the barrel stabiliser [22]. The securing means [34.1; 34.2] includes first locking means [34.1] located intermediate the barrel stabiliser [22] and the action [16]; and second locking means [34.2] located intermediate the barrel stabiliser [22] and the muzzle [18]. The first locking means [34.1] includes a barrel flange [36] which is complimentarily machined frictionally to engage the exterior wall surface [26] of the barrel [12]; and a locking seal [38] located intermediate the barrel flange [36] and the barrel stabiliser [22], such that the barrel stabiliser [22] is seated against the first locking means [34.1] for preventing axial displacement of the barrel stabiliser [22] towards the action [16] in use. The second locking means [34.2] includes a threaded lock nut [40] which is screwed into a complimentarily threaded end of the exoskeleton [20] and a locking seal [42] located intermediate the lock nut [40] and the barrel stabiliser [22], such that the second locking means [34.2] is seated against the barrel stabiliser [22] for preventing axial displacement of the barrel stabiliser [22] towards the muzzle [18] in use. In the embodiment of the invention which is illustrated in FIGS. 6 and 7, the threaded lock nut [40] is replaced with a threaded silencer engaging nut [48].

The barrel stabiliser [22] is heat conductive such that it serves as a heat sink, adapted to disperse heat away from the barrel [12] during firing.

Figures 1, 2:
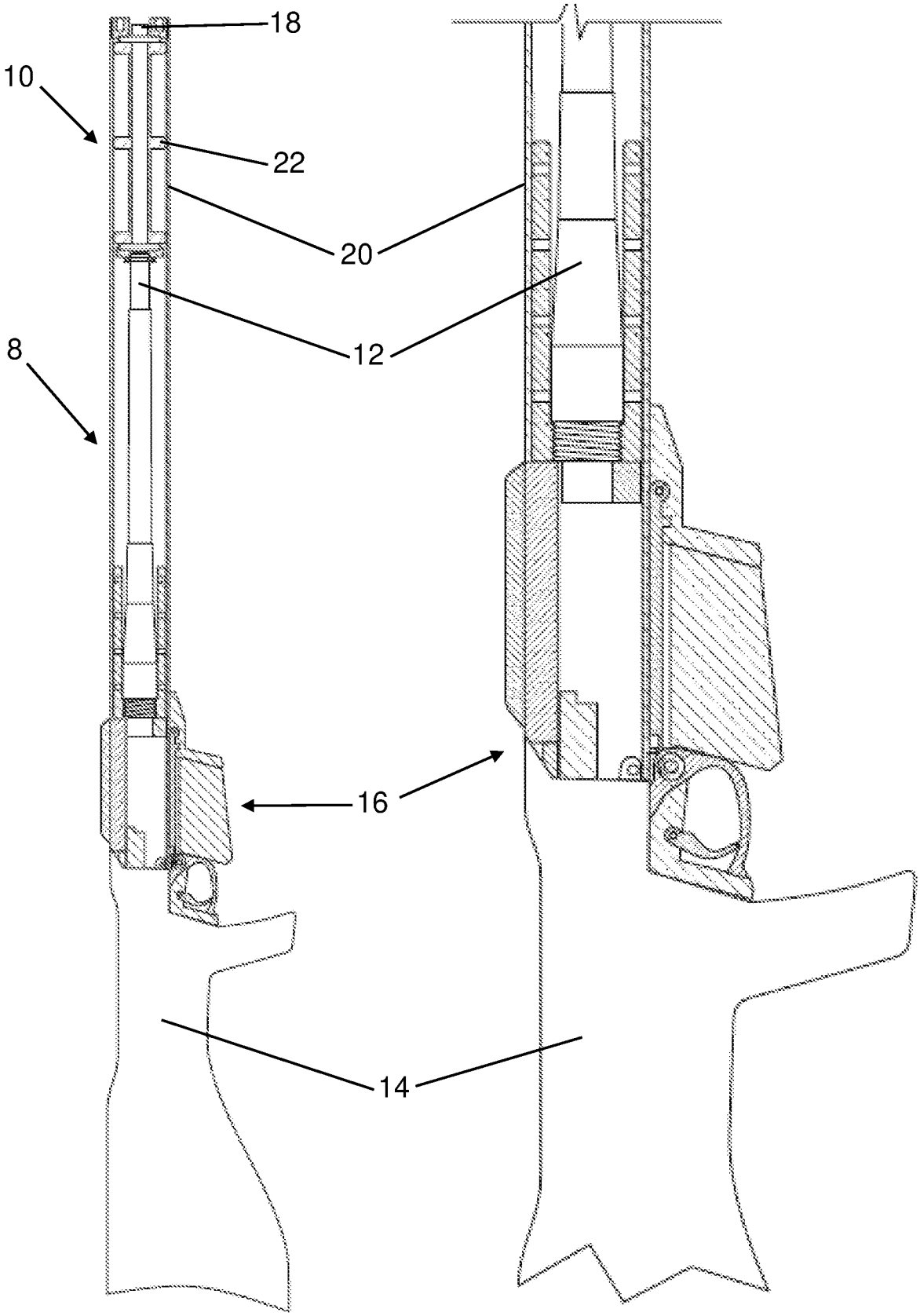
FIG. 1 is a diagrammatic illustration of a rifle including a first embodiment of the barrel flexing mitigation assembly of the invention in which the exoskeleton encases only the rifle barrel.
FIG. 2 is an enlarged view of the butt plate, stock and action of the rifle of FIG. 1.
Figure 3:
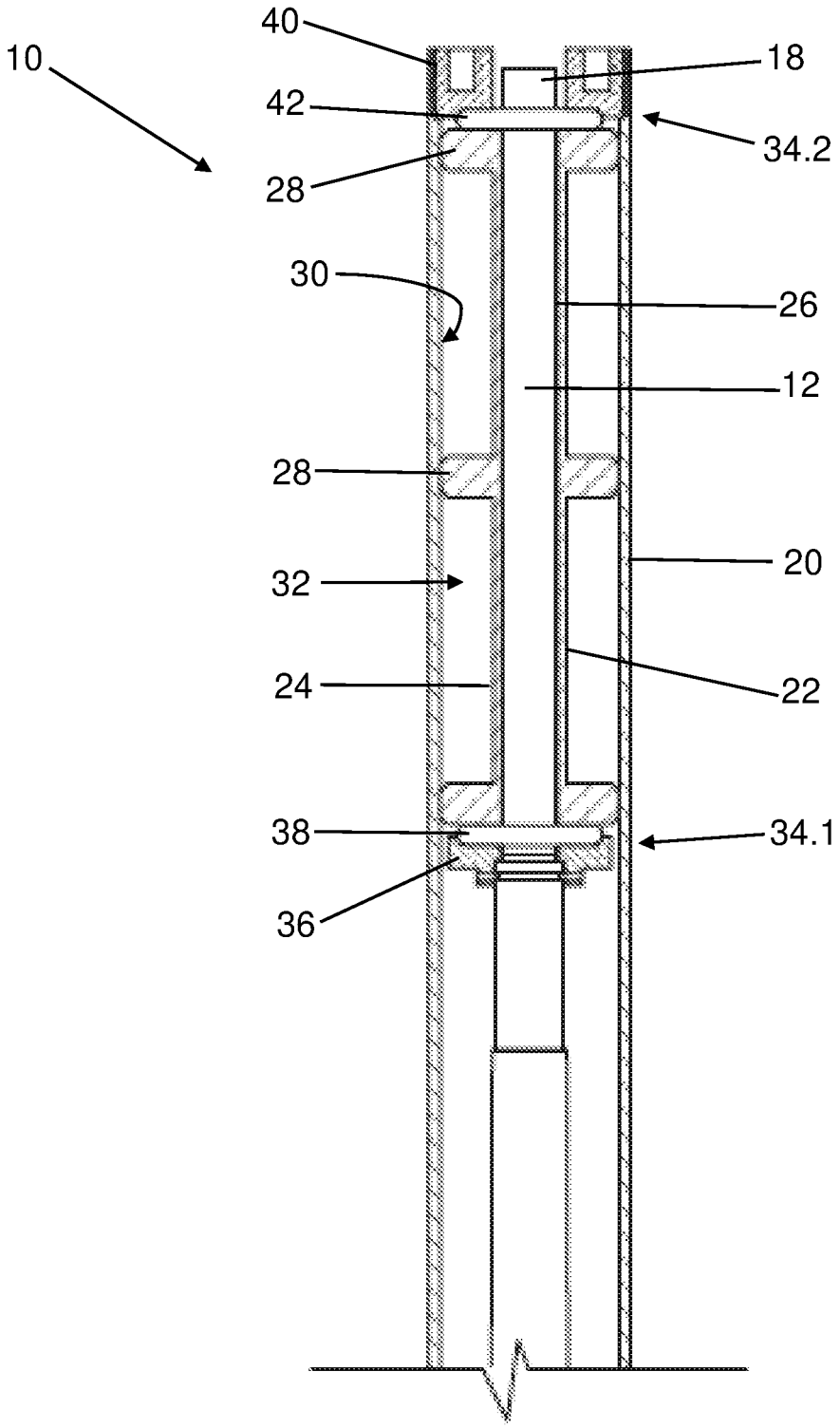
FIG. 3 is an enlarged view of the rifle of FIG. 1, illustrating the exoskeleton and barrel stabiliser approximate the muzzle.
Figure 4:
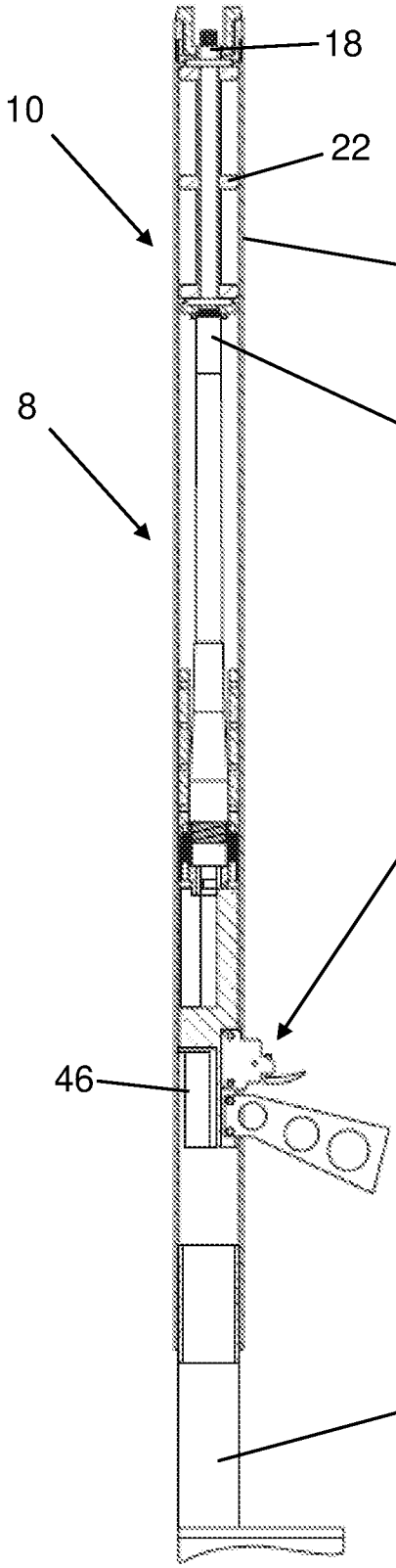
FIG. 4 is a diagrammatic illustration of a rifle including a second embodiment of the barrel flexing mitigation assembly of the invention in which the exoskeleton encases the entire rifle.
Figure 5:
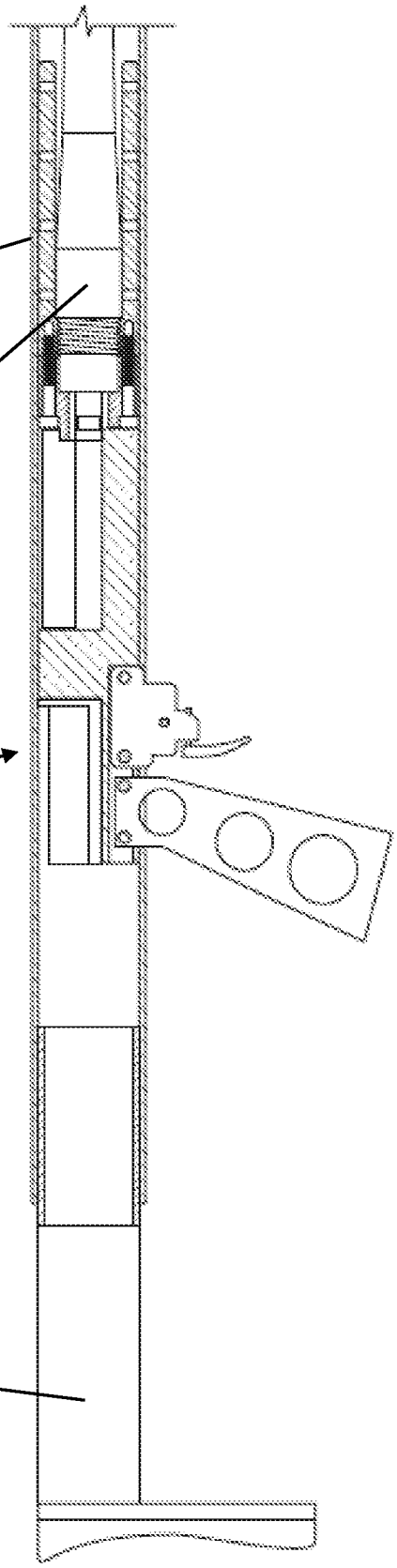
FIG. 5 is an enlarged view of the butt plate, stock and action of the rifle of FIG. 4.

In the embodiment of the invention illustrated in FIGS. 4 and 5, the tubular exoskeleton [20] extends coaxially with the barrel [12] from the muzzle [18] to the stock [14], such that it defines a rigid exoskeleton [20] within which the entire rifle [8] is encased and within which all moving parts, such as the breach bolt carrier assembly [46], slides.

The exoskeleton [20] provides for the possibility to optimize barrel [12] weight, which is the heaviest component of a rifle [8], as it allows for reducing barrel [12] dimensions to an absolute minimum required to remain within predetermined strength profiles as determined by pressure versus displacement ratios. In other words, where barrel [12] stability is currently achieved by increasing barrel diameter to provide heavy barrel configurations with free floating barrels, such as those required for precision rifles, the proposed invention diverts in the opposite direction by proposing instead to decrease barrel diameter and to support the barrel [12] in a non-free-floating assembly [10] against a radially extending exoskeleton [20].

It will be appreciated that other embodiments of the invention are possible without departing from the spirit or scope of the invention as defined in the claims.

The invention claimed is:

1. A barrel flexing mitigation assembly adapted for mitigating flexing of a barrel of a rifle during a firing process, wherein the rifle includes a stock, an action having a breech bolt carrier assembly, and a barrel terminating in a muzzle, the barrel flexing mitigation assembly comprising:

an elongate, tubular shaft extending coaxially with the barrel from the muzzle to the stock, such that the tubular shaft defines a rigid exoskeleton within which the entire rifle is encased and within which all moving parts, including the breech bolt carrier assembly, slide; and an elongate, tubular barrel stabiliser which is snug-fitted with a matching interface geometry and engaged to fit over at least a portion of the barrel, such that the tubular barrel stabiliser is radially positioned between the barrel and the tubular exoskeleton and stabilises the barrel into radial contact with the exoskeleton;

the barrel flexing mitigation assembly being such that the exoskeleton and barrel stabiliser jointly mitigate and absorb radial displacement of the barrel while a projectile is being fired.

2. The barrel flexing mitigation assembly according to claim 1, wherein the barrel stabiliser includes:

a tubular body which is snug-fitted over the barrel such that the tubular body engages an exterior wall surface of the barrel, and at least one spacer radially extending from the tubular body and dimensioned for pressing against an interior wall surface of the exoskeleton, the barrel flexing mitigation assembly being such that a radial chambers is defined between the tubular body of the barrel stabiliser and the exoskeleton.

3. The barrel flexing mitigation assembly according to claim 2, wherein the barrel stabiliser includes:

a number of spacers that radially extend between the tubular body and the exoskeleton such that the spacers frictionally engage the tubular body with the exoskeleton, wherein the spacers are positioned at regular intervals along a length of the tubular body such that a radial chamber is formed between each set of neighbouring spacers, the tubular body and the exoskeleton.

4. The barrel flexing mitigation assembly according to claim 1, wherein the barrel stabilisers is operatively associated with a securing assembly to secure the barrel stabiliser onto an exterior wall surface of the barrel so as to prevent axial displacement of the barrel stabiliser in use, the securing assembly being located coaxially with and on opposite sides of the barrel stabiliser.

5. The barrel flexing mitigation assembly according to claim 1, wherein the barrel stabiliser is heat conductive such that the barrel stabiliser serves as a heat sink, adapted to disperse heat away from the barrel during firing.

6. The barrel flexing mitigation assembly according to claim 1, wherein the tubular exoskeleton is a rigid metal exoskeleton adapted to provide strength and rigidity to the barrel, the exoskeleton having any cross-sectional profile including circular, rectangular, square, hexagonal, octagonal, triangular or variations thereof.

7. A rifle including a stock, an action having a breech bolt carrier assembly, a barrel terminating in a muzzle and a barrel flexing mitigation assembly, wherein the barrel flexing mitigation assembly comprises:

an elongate, tubular shaft extending coaxially with the barrel from the muzzle to the stock, such that the tubular shaft defines a rigid exoskeleton within which the entire rifle is encased and within which all moving parts, including the breech bolt carrier assembly, slide; and an elongate, tubular barrel stabiliser which is snug-fitted with a matching interface geometry and engaged fit over at least a portion of the barrel, such that the tubular barrel stabiliser is radially positioned between the barrel and the tubular exoskeleton and stabilises the barrel into radial contact with the exoskeleton;

the barrel flexing mitigation assembly being such that the exoskeleton and barrel stabiliser jointly mitigate and absorb radial displacement of the barrel while a projectile is being fired.

8. The rifle according to claim 7, wherein the rifle the barrel is a full-length, rifled barrel.

* * * * *